US006435097B1

(12) United States Patent
Garner et al.

(10) Patent No.: US 6,435,097 B1
(45) Date of Patent: Aug. 20, 2002

(54) PROTECTIVE DEVICE FOR DEPLOYABLE FINS OF ARTILLERY PROJECTILES

(75) Inventors: James M. Garner, Aberdeen; James M. Bender, Bel Air; Peter Dehmer, Brlair, all of MD (US); Melissa Klusewitz, Delta, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/828,441

(22) Filed: Apr. 9, 2001

(51) Int. Cl.[7] ..... F42B 10/14
(52) U.S. Cl. ..... 102/490; 244/3.29
(58) Field of Search ..... 244/3.24, 3.27–3.3; 102/374, 376, 489, 490, 520

(56) References Cited

U.S. PATENT DOCUMENTS 4,546,940 A * 10/1985 Anderson et al. ..... 244/3.29
4,736,908 A * 4/1988 Boder ..... 244/3.29
4,936,219 A 6/1990 Mudd ..... 102/520
5,103,734 A * 4/1992 Arnaud et al. ..... 102/489
5,474,256 A 12/1995 Garner ..... 244/324
6,336,609 B1 * 1/2002 Johnson ..... 102/490

* cited by examiner

*Primary Examiner*—Galen L. Barefoot
(74) *Attorney, Agent, or Firm*—Paul S. Clohan

(57) ABSTRACT

A low cost protective cap that will offer protection of deployable fins for full bore artillery projectiles. A form fitting, composite cap that disintegrates on muzzle exit acts as a protective measure. The cap interfaces with the projectile obturator to form a temporary seal against hot gun gasses. The composition and thickness of the cap allows gas infiltration into the cap material and essentially instant cap degradation upon shot exit.

6 Claims, 2 Drawing Sheets

PROTECTIVE DEVICE FOR DEPLOYABLE FINS OF ARTILLERY PROJECTILES

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

The present invention relates directly to in-bore protection of deployable (e.g., folded) fins for full bore artillery projectiles.

2. Discussion of Related Art

Ballistically launched projectiles are often exposed to severe temperature and pressure conditions. Untreated aluminum fins show melting in gun chambers that can reach temperatures of 3000 degrees K, and pressures of 50,000 psi. Insulating the deployable fins, from such conditions is paramount to assuring their ability to function.

In the prior art, U.S. patents have been issued that describe protection for projectile fins. Examples are the Mudd patent U.S. Pat. No. 4,936,219 entitled "Fin Protection Device" and the Garner patent U.S. Pat. No. 5,474,256 entitled "Combustible Fin Protection Device". Garner describes a fin cover that is designed to burn completely off as it moves to the bore exit. Mudd offers a more mechanical system for fin protection that shields the fin until muzzle exit. Also, the Mudd patent is directed at fixed-fin configurations, as that is what is depicted in the above cited patent figures. There is no mention or teaching directed at how such an invention would be applied to a deployable fin configuration. Mudd's general geometry description of a protective body consisting of a modified frustum is inapplicable to create protection for fins on a boattail, as shown in FIG. 1. Further, the Mudd patent does not show the use of trapped gun gas pressure within the protective body material to effectively disintegrate the protective body once the projectile exits the bore. The management of gun gas pressure to affect the discard or function of associated projectile parts (i.e., sabots, fins) is a terribly complex effort even to those skilled in the art, and as such is not obvious. The inconsistencies in managing high pressure gun gasses are compounded by factors such as: burn ignition delay, asymmetric propellant bed ignition, projectile gun barrel interactions, and material degradation (mainly water absorption). The Mudd patent does describe an internal pressure created by an explosive train to affect the opening of pivoted petals and eventual discard of the mechanism. But this has its own set of problems varying from adverse projectile tip-off rates to delayed discard and protective mechanism ignition train inconsistencies.

SUMMARY OF THE INVENTION

Accordingly, it is an object of the present invention to provide a protective cap to encase and conform to the rear section of artillery projectiles with deployable fins.

It is another object of the invention to provide a protective cap for deployable fins on artillery projectiles made from a material of sufficient porosity such that the cap disintegrates and discards on projectile muzzle exit.

It is a further object of the invention to provide a protective cap for deployable fins on artillery projectiles that integrates with the projectile obturator to form a temporary pressure in-bore seal.

It is another object of the invention to provide a method of retaining deployable fins on artillery in the stowed position before firing.

The foregoing and other objects are achieved by providing a low cost protective component that can be affordably implemented to offer protection of deployable fins for full bore artillery projectiles. The protective component interfaces with the projectile obturator to form a temporary seal against hot gun gasses. The composition and thickness of the protective component allows gas infiltration into the component material and essentially instant degradation upon shot exit.

The purpose of the insulating protective component is to keep hinged fins in the stowed position as well as insulate them from harmful gun gasses. The second part of the component's function is to disintegrate/discard upon muzzle exit. This allows the fins to deploy. Upon shot exit the component discards and imparts no significant launch rates or mechanical impulses to the projectile.

The protective component's function is determined by its geometry as well as material properties. It completely encases the rear of the projectile (i.e., everything back of the obturator). It also conforms to the shape of the projectile rear. One benefit to conforming to the shape of the projectile rear is that the it is supported by the projectile body and cannot crush under the chamber pressures as it is supported by the projectile body. Another benefit is that the additional chamber intrusion volume to accommodate it is minimal. Its front edge also interfaces with the obturator such that a seal can be formed. This seal creates a differential pressure that keeps the fins closed as long as the pressure difference exists. Its discard/disintegration on muzzle exit is aided by the choice of a material with medium porosity. This porosity allows seepage of high-pressure gun gas into its material. On projectile exit, the high-pressure gas tries to equilibrate and escape to the atmosphere and thus fragments/disintegrates it.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

A low cost protective component can be affordably implemented to offer protection of deployable fins for full bore artillery projectiles. A form fitting, composite cap that disintegrates on muzzle exit and acts as a protective measure. The cap interfaces with the projectile obturator to form a temporary seal against hot gun gasses. The composition and thickness of the cap allows gas infiltration into the cap material and essentially instant cap degradation upon shot exit.

The purpose of the insulating cap is to keep hinged fins in the stowed position as well as insulate them from harmful gun gasses. The second part of the cap's function is to disintegrate/discard upon muzzle exit. This allows the fins to deploy. Upon shot exit the cap discards and imparts no significant launch rates or mechanical impulses to the projectile.

The cap's function is determined by its geometry as well as material properties. The cap completely encases the rear of the projectile (i.e., everything back of the obturator). The cap also conforms to the shape of the projectile rear. A cap material thickness of nominally 0.040" is sufficient to provide inbore protection for the fins yet allows clean discard on exit. The cap front edge also interfaces with the obturator such that a seal can be formed; i.e., the cap overlaps the obturator or the obturator overlaps the cap. This seal creates a differential pressure that keeps the fins closed as long as the pressure difference exists.

Figure 1:
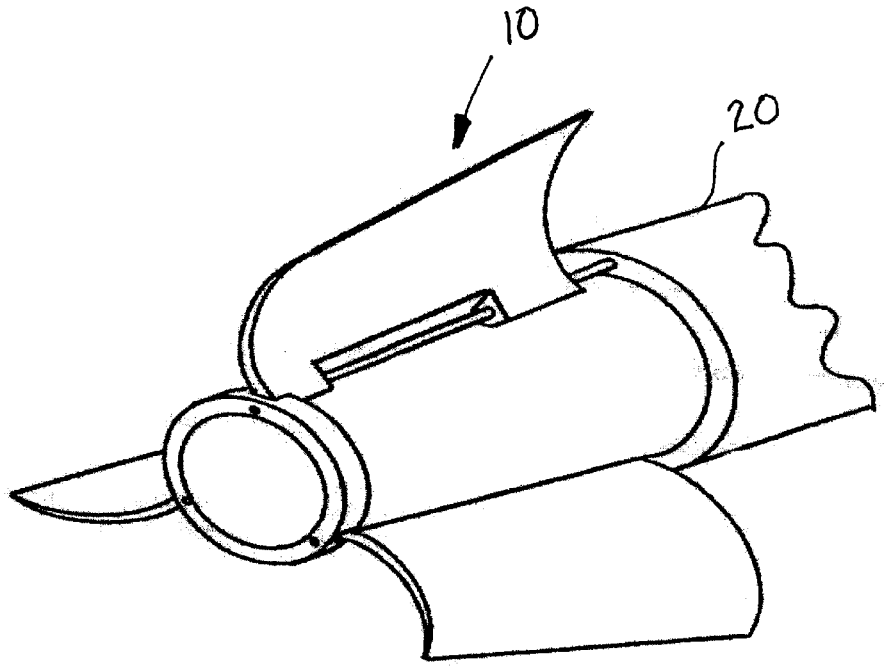
FIG. 1 shows an example of a projectile geometry that could benefit from the present invention.
Figure 2:
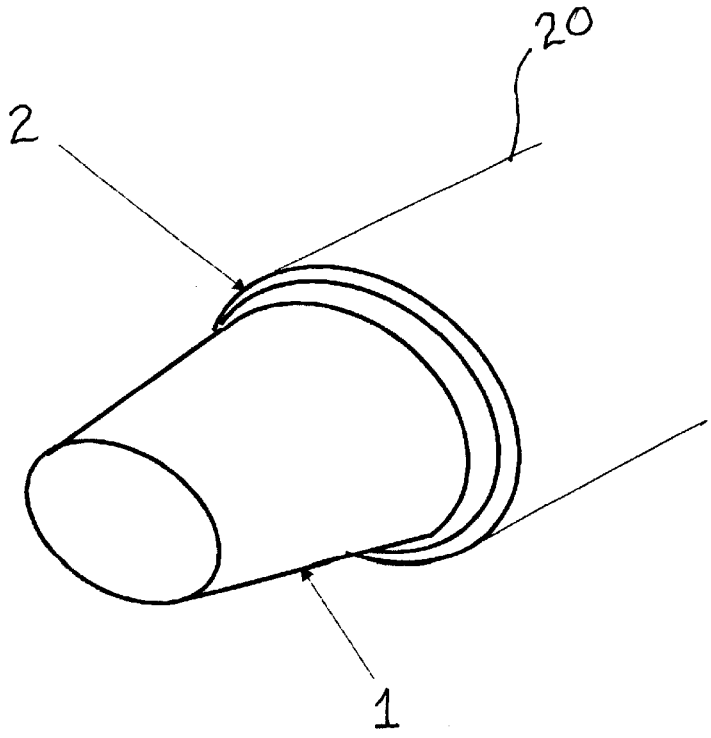
FIG. 2 shows more detail of the projectile geometry of FIG. 1.

FIG. 1 shows an example of a projectile rear area geometry that would benefit from such an insulating cap. Folding fins 10 are on a projectile 20 boattail, and cannot depend on the gun tube wall to help them remain closed. The same projectile 20 with the present invention incorporated is shown in FIG. 2. In FIG. 2, cap 1 keeps fins 10 stowed and insulates fins 10 from the chamber environment. The majority of damage occurs to fins 10 in-bore and out-of-bore aerodynamic heating damage is far less severe.

The use of a material that conforms to and is insulative of cap 1 will achieve the goal of projectile fin protection. Flexible materials have the benefit of being easily formable or machineable. The use of plastics or fiberglass or other reinforcement in an epoxy resin for this purpose is ideal, though not exclusive, as they meet the aforementioned criteria of being non-heat conductive and moldable before the resin hardens. The ability of such cap 1 materials to be injection-molded, or vacuum formed, are also benefits. These materials are of reasonable cost and easy availability as well. Cap 1 also interfaces with obturator 2 to affect a temporary seal.

Figure 3:
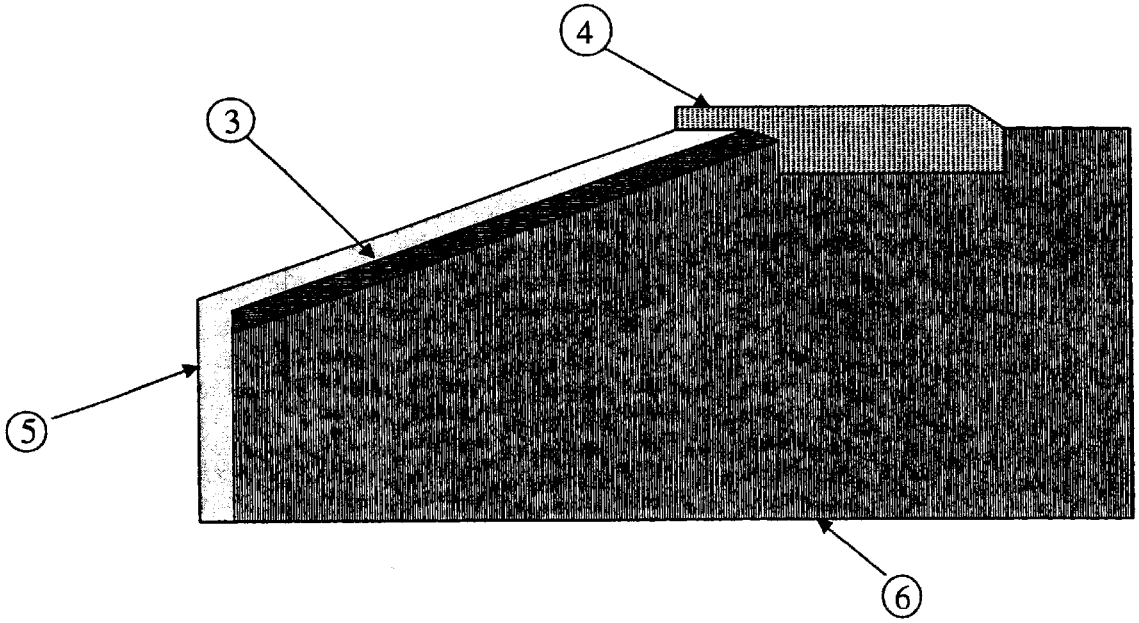
FIG. 3 is a cross sectional view of the protective cap configuration of the present invention.

A more detailed cross sectional view is given in FIG. 3. Protective cap 5 encases folded fin 3 and projectile body 6 as well as interfacing with obturator 4 to form a seal.

The advantages of the present invention over the prior art are evident in a number of situations. Deployable fins are presently used on ballistically launched projectiles. If these fins deploy prematurely (in-bore) substantial damage often results. Typically, deployable fins are held in place by the confines of the gun tube wall or a pusher sabot. Some problems associated with using gun tube walls to keep the fins closed are: (1) the exposure of the fin to the hot, high pressure gun gasses, or (2) the inefficiency of bulky, discarding, sometimes heavy parts required to keep the fins closed until bore exit. Small parts such as springs are often displaced or deformed when subjected to high pressures. Also, the creation and engineering of a substantial protective metal enclosure, as described by Mudd, for the fins would be difficult and costly. Our protective cap mitigates these problems. The protective cap acts to prevent damage to the fins even before the projectile is loaded by keeping the fins stowed while out-of-bore. The cap is also lightweight enough so that its use presents no logistical burden due to weight or volume. Since the cap is conformal it has potential use on a wide variety of rounds. The least suited application for the cap is a kinetic energy penetrator. On most kinetic energy penetrator rounds the fins are fixed. And, while the cap is useable on rounds with fixed fins, modification for this type of use would be extensive.

With respect to the Mudd patent, the present invention has a number of advantages. The Mudd patent requires a protective body material or geometry that would be substantial (i.e., thick) to adequately protect the fins and keep itself from being crushed under the high gun gas pressures. Consequently, bulky, heavy discarding parts pose the potential to impart adverse angular rates to the projectile as well as posing a danger due to their own erratic flight after discard. The weight alone of the Mudd device would probably be prohibitive. In addition the explosive mechanism suggested by Mudd in his FIG. 3 would require extra precautions in the round's creation and logistics. The one piece, no moving parts, lightweight, non-volatile protective cap of the present invention is clearly superior.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A device to protect the deployable fins of an artillery projectile comprising:

a form-fitting protective cap over said deployable fins made from a material of sufficient porosity such that said cap disintegrates and discards on projectile muzzle exit.

2. The device of claim 1 wherein said protective cap integrates with an obturator on said projectile to form a temporary pressure in-bore seal.

3. The device of claim 2 wherein said cap's discard and disintegration on projectile muzzle exit is aided by said material having medium porosity, which allows seepage of high-pressure gun gas into the cap material, wherein on projectile exit high-pressure gas tries to equilibrate and escape to the atmosphere and thus fragments and disintegrates said cap.

4. The device of claim 3 wherein said cap material has a thickness of 0.035" to 0.060".

5. The device of claim 3 wherein said material is flexible.

6. The device of claim 5 wherein said flexible material is a plastic.

* * * * *